US009264810B2

(12) United States Patent
Gioscia et al.

(10) Patent No.: US 9,264,810 B2
(45) Date of Patent: Feb. 16, 2016

(54) DIRECTED AUDIO

(75) Inventors: Richard Gioscia, Santa Clara, CA (US); Philip Bryan, Menlo Park, CA (US); Michael Christian Ryner, Brentwood, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 708 days.

(21) Appl. No.: 13/600,653

(22) Filed: Aug. 31, 2012

(65) Prior Publication Data

US 2014/0064537 A1 Mar. 6, 2014

(51) Int. Cl.

| | |
|---|---|
| ***H04R 1/02*** | (2006.01) |
| ***H04R 3/04*** | (2006.01) |
| *H04R 1/28* | (2006.01) |

(52) U.S. Cl.

CPC ..... *H04R 3/04* (2013.01); *H04R 1/2803* (2013.01); *H04R 2499/11* (2013.01)

(58) Field of Classification Search

CPC ..... H04R 3/04; H04R 1/2803; H04R 2499/11
See application file for complete search history.

(56) References Cited

U.S. PATENT DOCUMENTS

| | | | | |
|---|---|---|---|---|
| 5,742,690 | A * | 4/1998 | Edgar | 381/300 |
| 2005/0129258 | A1* | 6/2005 | Fincham | 381/160 |
| 2013/0128130 | A1* | 5/2013 | Yamauchi | H04N 5/642 348/836 |

OTHER PUBLICATIONS

Liszewski, A., Ohgizmo! Review-Sony Tablet S, (Web Page), Sep. 16, 2011.
Nokia X2 Pictures, (Web Page), http://www.gsmarena.com/nokia_x2-pictures-3304.php.
Review Fujitsu Siemens Amilo Xi2428, (Web Page).

* cited by examiner

*Primary Examiner* — Fan Tsang
*Assistant Examiner* — Eugene Zhao
(74) *Attorney, Agent, or Firm* — HP Legal Department

(57) ABSTRACT

Embodiments provide apparatuses and systems which include a front surface, a back surface, and a second back surface. A speaker may be disposed between the front surface and the back surface. The speaker is to direct audio substantially orthogonally through the back surface. The second back surface is to enable an acoustic response from the speaker. A method is also provided which enables a computing device to determine whether it is engaging a surface. In response to the determination, the computing device may adjust the audio signal provisioned to a speaker directed orthogonally to the surface, and output the audio signal to provision an omni-directional acoustic response.

20 Claims, 4 Drawing Sheets

DIRECTED AUDIO

BACKGROUND

Computing devices such as tablets, slates, mobile phones, smart phones, televisions and others utilize display screens to output images to a user and one or more speakers to output audio. The audio and images may be synchronized with each other, for example when the device is utilized for watching a movie, or they may be independent of each other, for example when a user is browsing the web or listening to music.

DETAILED DESCRIPTION

Computing devices are often utilized to convey media to a user. Media may include video, images, and/or audio. As the demand for smaller and smaller computing devices grows, the ability to provision high quality media is impacted. For example, as housings for the computing devices become smaller in size, it becomes more difficult to incorporate displays and speakers, along with the other components. With respect to speakers, not only do the components themselves need to become smaller, the area utilized to produce high quality sound is also impacted. Generally, speakers utilize a volume or cabinet space to generate sound waves. If the volume is diminished, the audio may be compromised. This in addition to a need for audio directionality and intended positioning of the computing devices prevents the use of speakers in various positions.

In the present disclosure, various examples are discussed that enable high quality audio in computing systems utilizing novel speaker placement and audio signal adjustment. The computing devices may comprise: slates, tablets, mobile phones, smart phones, notebook computers, desktop computers, televisions, or other computing devices. While the present disclosure will be discussed primarily in the context of a tablet, it is expressly noted that the disclosure is not so limited.

Figure 1:
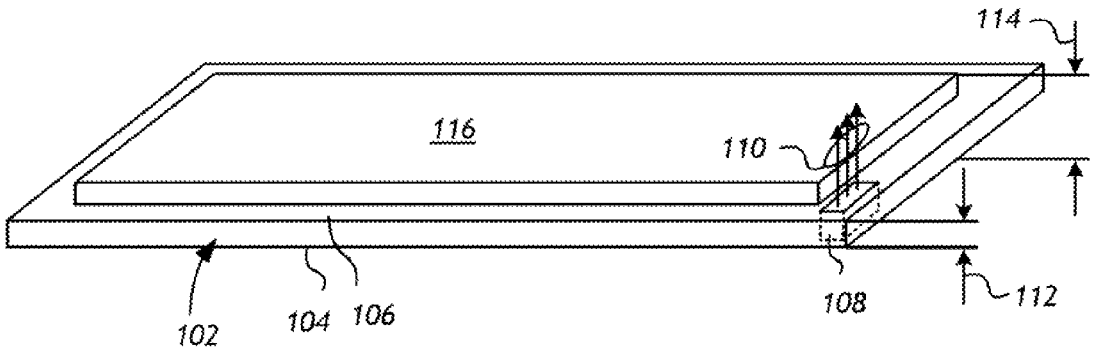
FIG. 1 is a perspective view of an apparatus in accordance with an example of the present disclosure

Referring to FIG. 1, a perspective view of an apparatus is illustrated in accordance with an example of the present disclosure. The apparatus includes a housing 102 having a front planar surface 104, a first back planar surface 106, and a second back planar surface 116. Disposed within the housing 102 is a speaker 108 to direct audio 110 substantially orthogonally through the first back planar surface 106. Other components may be included without deviating from the instant disclosure, but have been left out of the figure for ease of discussion.

In the illustrated example, the housing 102 includes multiple surfaces. The multiple surfaces include the front planar surface 104, the first back planar surface 106, and the second back planar surface 116. A planar surface as used herein is a substantially flat surface. Each of the front and back planar surfaces are substantially parallel to one another, however, in other examples, various other components may be attached to or integrated with the planar surfaces, for example bumpers and/or friction devices to support the housing when placed on supporting surfaces.

Materials for the housing 102 and various surfaces 104, 106, 116 may include various transparent materials, such as glass or plastics, various metals, for example aluminum or steel. The various surfaces 104, 106, 116 may be manufactured such that the surfaces are integrated into a single housing, or alternatively, the various surfaces may be manufactured independently of one another and assembled together with various other components. Various paints, scratch resistant seals, and rubberized coatings may also be included, among other materials. The various surfaces may comprise combinations of materials. For example, the front planar surface 104 may comprise a predominantly glass surface; the first back planar surface 106 may comprise a predominantly plastic surface; and the second back planar surface 116 may comprise a predominantly aluminum surface with a soft touch paint. Other combinations are contemplated.

Disposed within the housing 102 is a speaker 108. The speaker 108 is disposed between the front planar surface 104 and the first back planar surface 106. The speaker 108 is disposed such that it directs audio 110 substantially orthogonally through the first back planar surface 106. The speaker 108 may be any speaker configured to generate audio in response to an audio signal. The speaker 108 may be disposed within the housing 102 or disposed within a cabinet within the housing 102. In various examples, the first back planar surface 106 may include one or more slots, holes, or channels into the housing 102 such that the audio may escape the housing in an efficient manner (viewed more easily in FIG. 2). In various examples, the speaker 108 may be a rectangular speaker configured to generate audio having varying frequencies including, low, mid-range, and high frequencies. In one example, the speaker may be a 9×14 mm speaker.

The second back planar surface 116 may be disposed substantially parallel to the first back planar surface 106 to enable an acoustic response from the speaker 108, wherein the acoustic response comprises a reflection of the audio directed substantially orthogonally through the first back planar surface 106. The acoustic response may be enabled via the distance between the first back planar surface 104 and the second back planar surface 110. This may be the difference between height 114 and height 112, which are defined by the various planar surfaces 104, 106, and 116. In various examples the various planar surfaces may be substantially rectangular in shape.

Figure 2:
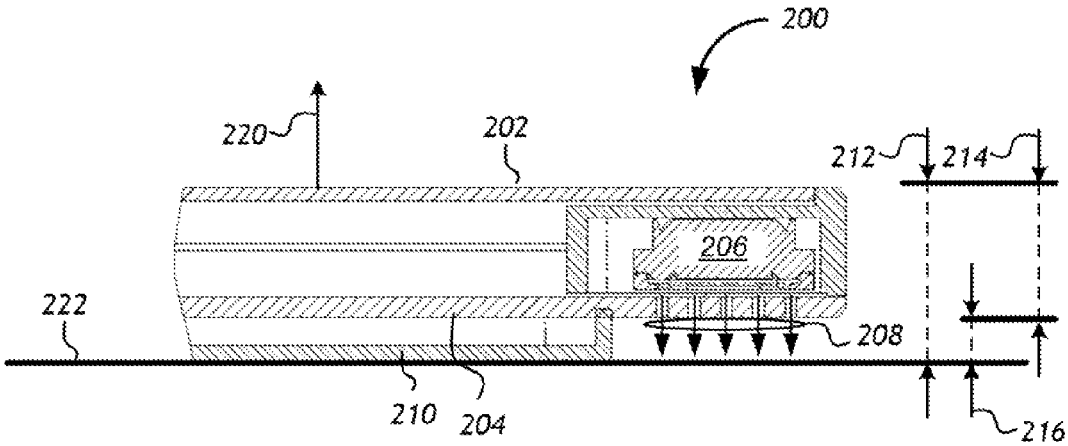
FIG. 2 is a cross sectional view of an apparatus in accordance with an example of the present disclosure.

In one example, the second back planar surface 116 may be integral with a pan that couples directly to the first back planar surface 106 and includes a depth. The pan may have dimensions smaller than that of the first back planar surface 106 forming a ledge around the periphery of the pan. Additionally, the depth of the pan may enable an acoustic response from the speaker 108 when the system is held by a user's hand or alternatively placed on a flat supporting surface such as a table, desk or other surface (as illustrated in FIG. 2). In addition to providing a necessary depth for an acoustic response, the pan may provision a housing for various electronic components, for example a motherboard, memory, or other components utilized for the proper functioning of the overall system.

In various examples, the acoustic response 110 from the speaker 108 may be provided via one or more reflections from a supporting surface. The reflections off the surface may disperse the audio giving an omni-directional presence to a user. An omni-directional presence may appear to a user as surround sound. The acoustic response may be determined based upon the positioning of the first back planar surface 106 relative to the second back planar surface 116.

Referring to FIG. 2, a cross sectional view of a system 200 is illustrated in accordance with an example of the present disclosure. The system 200 includes a display surface 202; a first back surface 204 disposed a first distance 214 from the display surface 202; and a second back surface 210 disposed a second distance 212 from the display surface 202, wherein the second distance 212 is greater than the first distance 214. In addition, the system 200 may include a speaker 206 disposed between the display surface 202 and the first back surface 204, and a display 218. The speaker 206 and the display 2018 may be oriented in generally opposite directions and configured to output media 208, 220 in said generally opposite directions.

In various examples, the first and second distances 212, 214 may be determined to provide an acoustic response while providing an aesthetically pleasing slim appearance. For example, the first and second distances may be determined such that they create a depth 216 to enable audio 208 to be directed orthogonally through the first back planar surface 204 and produce an acoustic response that is not immediately muted by a supporting surface 222. A supporting surface 222 may include a table, desk, protective case, a user's hand, lap, or other surface.

In the illustrated example the display 202 is configured to direct an image substantially orthogonal, as indicated by arrow 220, to the display surface 202. The speaker 206 is to direct audio substantially orthogonal, as indicated by arrows 208, to the first back surface 204. In various examples, a side wall coupled to the second back surface 210 may be configured to interact with audio 208 from the speaker 206 to provide a reflected acoustic response. This may be in addition to any acoustic response intended from a support surface 222 described previously.

As used herein, an acoustic response may be any response to the audio propagated by the speaker 206 once interfered with by another object, for example, a support surface 222 or an appendage of a user. In at least one example, a controller (not illustrated) disposed within the system may adjust audio to the speaker 206 based on an orientation of the system. The controller, based on the orientation, may determine an acoustic response is likely. For example, if the controller determines the system to be lying flat, the controller may determine that any audio propagated by the speaker 206 is likely to engage a reflective surface, for example the lap of a user or a support surface 222. The controller may adjust the audio signal accordingly. In another example if the controller determines that the system is upright, the controller may determine that any audio propagated by the system is not likely to engage a reflective surface, for example that the system is being held by a user. The controller may then adjust the audio accordingly.

In various examples, adjusting the audio signal may include increasing or decreasing a volume of the audio signal, increasing or decreasing a level or power of an independent a range of frequencies (e.g., low, mid-range, or high), or altering another audio characteristic of the signal such as adding predefined settings, i.e., reverb effects. The system may make determinations of orientation based upon data received via sensors. Sensors may include pressure sensors, gyroscope sensors, image sensors, or others.

Figure 3:
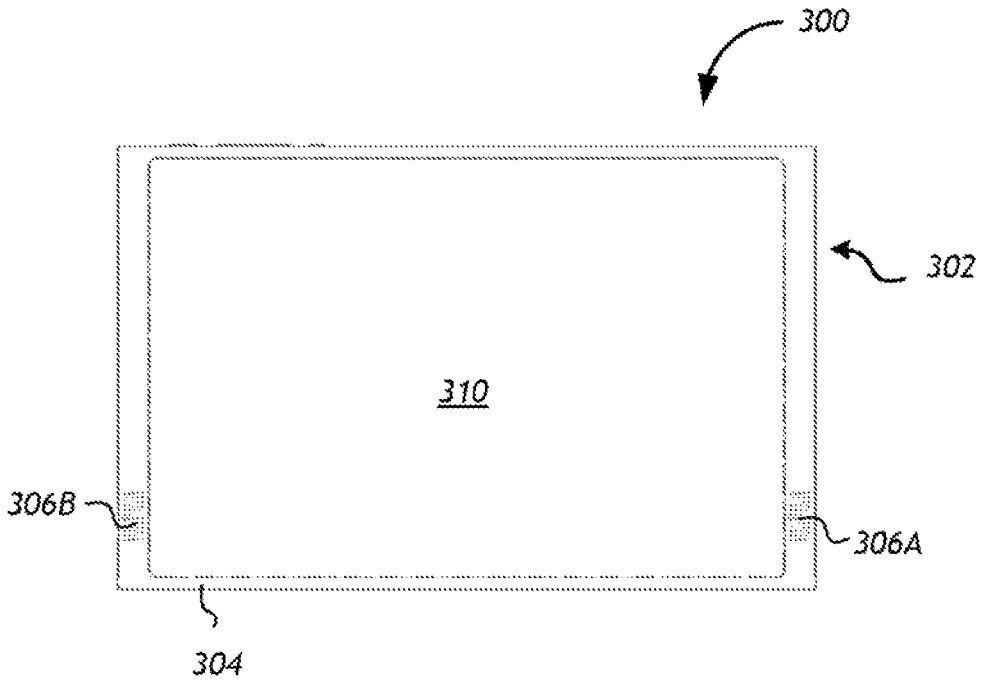
FIG. 3 is an elevational view of the bottom of an apparatus in accordance with an example of the present disclosure.

Referring to FIG. 3, an elevational view 300 of the bottom of an apparatus is illustrated in accordance with the present disclosure. The elevational view 300 illustrates a system having a front planar surface 302 (not clearly visible given the bottom elevational view), a first back planar surface 304, a second back planar surface 310. Disposed between the front planar surface 302 and the first back planar surface 304 are a first speaker 306A and a second speaker 306B. The speakers 306A-B are directly substantially orthogonally through the first back planar surface 304.

As illustrated, the front planar surface 302, the first back planar surface 304, and the second back planar surface 310 are substantially rectangular in shape. The second back planar surface 310 is illustrated as being smaller in dimension relative to the first back planar surface 304. This difference in dimension provisions a ledge or step around the periphery of the second back planar surface 310. The ledge or step enables audio from speakers 306A-B to propagate orthogonally through the first back planar surface 304 when the system is placed on a support surface or alternatively held by a user. While not illustrated, given the elevational view, the second back planar surface 310 is to elevate the first back planar surface 304 a predetermined height above a supporting surface to disperse the audio directed substantially orthogonally through the first back planar surface 304 to generate an omnidirectional acoustic response.

Figure 4:
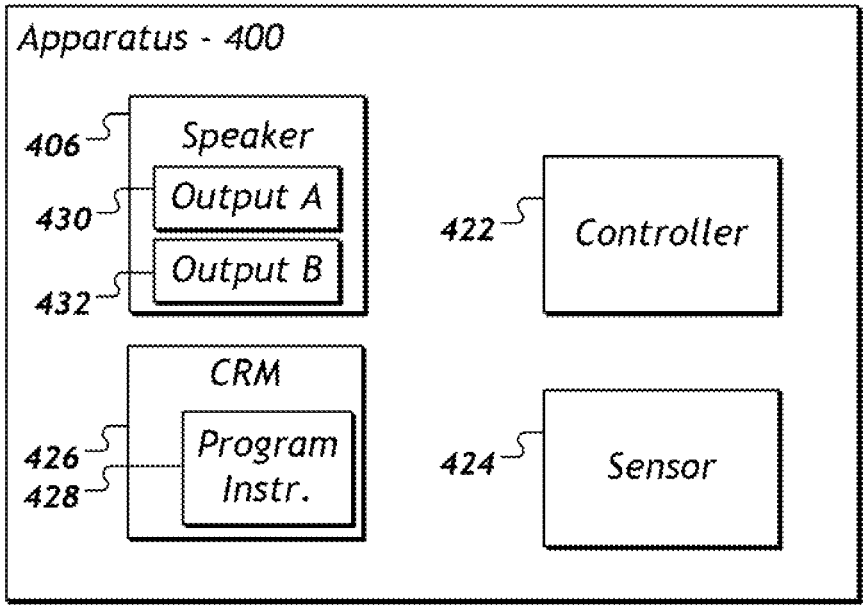
FIG. 4 is a block diagram of a system in accordance with an example of the present disclosure.

Referring to FIG. 4, a block diagram of a system is illustrated in accordance with an example of the present disclosure. The block diagram 400 includes a speaker 406, a controller 422, a sensor 424, a non-transitory computer readable medium 426 having programming instructions 428 stored thereon. The controller 422 may be configured to load and execute the instructions 428 stored within the computer readable medium 426.

In various examples, the apparatus 400 may be an apparatus or system as described with reference to FIGS. 1-3. The sensor 424 of the system 400 may be configured to determine an orientation of the computing device. The orientation as used herein may be an upright, horizontal, diagonal orientation. Alternatively, or in addition to the orientation, the sensor may determine whether the system is engaging a supporting surface, for example, a table.

In response to the determination of orientation and/or surface engagement, the controller may determine an adjustment for an audio signal to be transmitted to the speaker 406 for conversion to audio output. The audio signal may be consistent with a first output 430 or a second output 432, wherein the first output 430 is different than the second output 432. In various examples, the adjustment to the audio may include increases or decreases in volume, changes or alterations to particular frequencies or ranges of frequencies, or other known signal processing techniques. This, in various examples, may enable an automated and customized sound experience.

Figure 5:
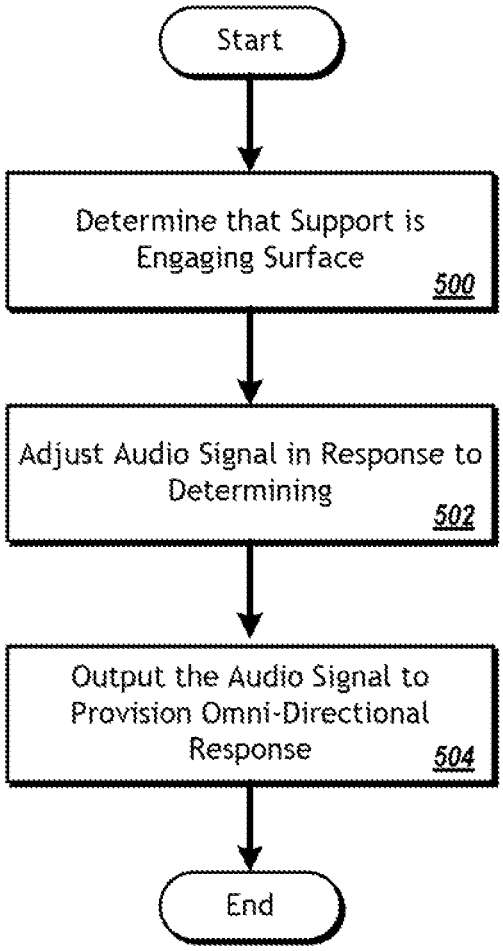
FIGS. 5-6 illustrate flow diagrams in accordance with multiple examples of the present disclosure.
Figure 6:
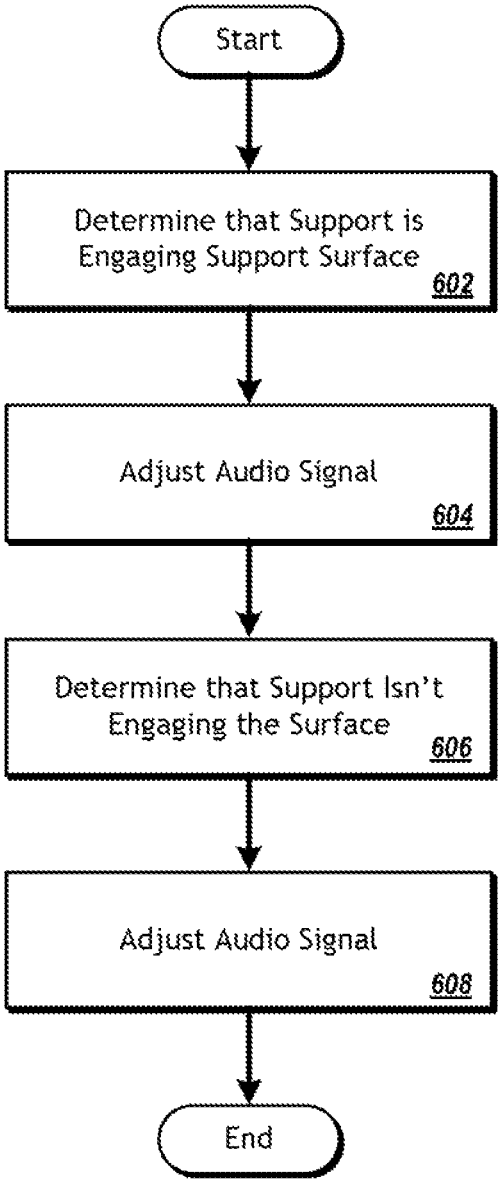

Referring to FIGS. 5-6 various flow diagrams are illustrated in accordance with examples of the present disclosure. While the flow diagrams illustrate various elements in a particular order, the disclosure should be construed to require the illustrated sequence. Rather, it is expressly contemplated that various elements may occur in other orders or simultaneous with various elements. In addition, various ones of the elements may be embodied in instructions stored on a computer readable medium, such as the computer readable medium of FIG. 4.

Referring to FIG. 5, the flow diagram may begin at 500 where a computing device, for example a computing device as discussed with reference the preceding figures, may determine that a support, for example a second back surface of the computing device, is engaging a surface. In various examples, the computing device may utilize one or more sensors to make the determination. For example, a computing device may utilize a pressure sensor to determine that the computing device is engaging a support surface. Alternatively, the computing device may utilize a gyroscopic sensor to determine an orientation of the computing device. Other sensors are contemplated.

In response to the determining, the computing device may adjust an audio signal provisioned from a speaker directed orthogonally to a surface of the computing device at 502. For example, the computing device may adjust an audio signal in a first manner in response to a determination that the computing devices is engaging a surface; and adjust an audio signal in a second manner in response to a determination that the computing device is not engaging a surface.

Subsequent to adjusting the audio signal, the computing device may output the audio signal to provision an omni-directional acoustic response at 504. Output the audio signal to provision the omni-direction acoustic response at 504 may enable a user to perceive a high quality audio signal. The flow diagram may then end.

Referring to FIG. 6, another flow diagram is illustrated in accordance with an example of the present disclosure. The flow diagram may begin, similar to FIG. 5, by the computing device determining that a support of the computing device is engaging a surface at 600. The support may be, for example, a second back surface, with reference to FIGS. 1-4. Determining whether the computing device is engaging a support surface may enlist the use of one or more sensors. The sensors in various examples, may include pressure sensors, gyroscopic sensors, or others.

In response to the determining, the computing device may adjust the audio signal at 602. Adjusting the audio signal may include adjusting a volume of the audio signal. In one example, in response to determining that the computing device is engaging a surface, the computing device may decrease a volume. In other examples, the volume may be increased. In still other examples, the computing device may adjust the audio signal by adjusting a frequency of the audio signal. Adjusting the frequency of the audio signal may include, among other things, increasing or decreasing a power level to a frequency or a range of frequencies.

In response to adjusting the audio, the computing device may output the audio to provision an omni-direction acoustic response at 604. Subsequent or during output of the audio, the computing device may determine that the support is no longer engaging the surface at 606. Again, one or more sensors may be utilized in making the determination. In response to the determination that the support is no longer engaging the surface, the computing device may adjust the audio signal at 608. In one embodiment, adjusting the audio signal may include increasing a volume of the audio signal. The increase in various examples may be in response to an estimated loss of reflection from the support surface. In other examples, other adjustments may be made to the audio signal. The method may then end at 610.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a wide variety of ways. This application is intended to cover any adaptations or variations of the embodiments discussed herein. Therefore, it is manifestly intended that embodiments be limited only by the claims and the equivalents thereof.

What is claimed is:

1. An apparatus, comprising:

a housing of a portable computing device comprising a front planar surface and a first back planar surface, wherein the first back planar surface is parallel to the front planar surface, wherein the front planar surface is parallel to a display that directs an image through the front planar surface;

a speaker disposed within the housing, wherein the speaker is to direct an audio orthogonally through the first back planar surface; and a second back planar surface parallel to the first back planar surface to enable an acoustic response to the audio from the speaker when the second back planar surface is determined by the portable computing device to engage a supporting surface, wherein the acoustic response comprises a reflection of the audio directed orthogonally through the first back planar surface.

2. The apparatus of claim 1, further comprising:

a second speaker disposed within the housing, wherein the second speaker is to direct another audio orthogonally through the first back planar surface.

3. The apparatus of claim 1, wherein the front planar surface, the first back planar surface, and the second back planar surface are rectangular in shape.

4. The apparatus of claim 1, wherein the second back planar surface is to elevate the first back planar surface a predetermined height above a supporting surface to disperse the audio directed orthogonally through the first back planar surface to generate an omni-directional acoustic response.

5. The apparatus of claim 1, further comprising:

the display disposed between the front planar surface and the first back planar surface, wherein the display is to direct the image orthogonally through the front planar surface.

6. The apparatus of claim 1, further comprising:

a controller disposed between the first back planar surface and the second back planar surface, wherein the controller is to modify an audio signal transmitted to the speaker based on an orientation of the apparatus.

7. A system, comprising:

a display surface of a portable computing device that is parallel to a front planar surface, wherein the display surface directs an image through the front planar surface;

a first back surface disposed a first distance from the display surface, wherein a speaker and the display are disposed between the display surface and the first back surface, the speaker and display oriented in opposite output directions; and a second back surface disposed a second distance from the display surface, wherein the second distance is greater than the first distance and configured to enable an acoustic response to an audio emitted through the first back surface from the speaker when the second back surface is determined by the portable computing device to engage a supporting surface.

8. The system of claim 7, wherein the second back surface when coupled to the first back surface provides a step around a periphery of the system.

9. The system of claim 7, wherein the speaker is disposed between the display and the first back surface such that the audio is to engage a hand of a user.

10. The system of claim 7, wherein the display directs the image orthogonal to the front planar surface.

11. The system of claim 7, further comprising:

a sensor to determine an orientation of the system.

12. The system of claim 11, further comprising:

a controller to adjust the audio from the speaker based on the orientation of the system.

13. The system of claim 12, wherein the controller is to increase a volume of the audio based on the orientation of the system.

14. The system of claim 12, wherein the controller is to increase a level of at least one frequency associated with the audio based on the orientation of the system.

15. The system of claim 7, wherein the second back planar surface is configured to redirect a portion of the audio directed orthogonal to the first back planar surface.

16. A method, comprising:

determining, by a portable computing device, that a support of the portable computing device is engaging a supporting surface, wherein the portable computing device comprises a front planar surface and a back planar surface, wherein the back planar surface is parallel to the front planar surface, wherein the front planar surface is parallel to a display that directs an image through the front planar surface;

adjusting, by the portable computing device, an audio signal in response to the determining, wherein the audio signal is provisioned to a speaker that emits an audio orthogonal to the back planar surface and the supporting surface;

outputting, by the portable computing device, the audio signal to provision an omni-directional acoustic response.

17. The method of claim 16, wherein the adjusting the audio signal comprises adjusting a volume of the audio signal.

18. The method of claim 16, wherein the adjusting the audio signal comprises adjusting a frequency of the audio signal.

19. The method of claim 16, further comprising:

determining, by the portable computing device, that the support is not engaging the supporting surface; and adjusting, by the portable computing device, the audio signal in response to the determining.

20. The method of claim 19, wherein the adjusting comprises increasing a volume of the audio signal.

* * * * *